US009820348B2

(12) United States Patent
Creusen et al.

(10) Patent No.: US 9,820,348 B2
(45) **Date of Patent: *Nov. 14, 2017**

(54) METHOD AND DEVICE FOR LIGHTING A SPACE USING AN LED STRING

(71) Applicant: PHILIPS LIGHTING HOLDING B.V., Eindhoven (NL)

(72) Inventors: Martinus Petrus Creusen, Wijlre (NL); Ralph Kurt, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/091,322

(22) Filed: Apr. 5, 2016

(65) Prior Publication Data

US 2016/0219665 A1 Jul. 28, 2016

Related U.S. Application Data

(62) Division of application No. 14/004,745, filed as application No. PCT/IB2012/051147 on Mar. 12, 2012, now Pat. No. 9,313,848.

(30) Foreign Application Priority Data

Mar. 18, 2011 (EP) ..... 11158819

(51) Int. Cl.
*H05B 33/08* (2006.01)

(52) U.S. Cl.
CPC ..... *H05B 33/083* (2013.01)

(58) Field of Classification Search
CPC .... H05B 37/02; H05B 33/08; H05B 33/0812; H05B 33/0815; H05B 33/0824;
(Continued)

(56) References Cited

U.S. PATENT DOCUMENTS 5,833,355 A 11/1998 You et al.
7,081,722 B1 * 7/2006 Huynh ..... H05B 33/0818 315/185 S (Continued)

FOREIGN PATENT DOCUMENTS

EP 2254392 A2 11/2010
EP 2299783 A2 3/2011

(Continued)

*Primary Examiner* — Thai Pham
(74) *Attorney, Agent, or Firm* — Akarsh P. Belagodu

(57) ABSTRACT

In a method of lighting at least part of a space, a light emitting diode (LED) string is used. The LED string comprises a first LED segment and at least one further LED segment, which are connected in series, each LED segment comprising at least one LED. The LED string is powered by a rectified AC voltage. The first LED segment is powered when the rectified AC voltage is above a first voltage level, and the first LED segment and the further LED segment are powered when the rectified AC voltage is above a second voltage level higher than the first voltage level. The first LED segment is arranged to radiate light to a first volume of the space, and the further LED segment is arranged to radiate light to a second volume of the space, the first volume being at least partly different from the second volume. The first volume may at least partly overlap the second volume.

20 Claims, 9 Drawing Sheets

(58) Field of Classification Search
CPC H05B 33/083; H05B 33/0842; H05B 33/084; H05B 33/0845
USPC ... 315/122, 185 R, 194, 201, 291, 294, 297, 315/307, 308, 312
See application file for complete search history.

(56) References Cited

U.S. PATENT DOCUMENTS

| | | | | |
|---|---|---|---|---|
| 7,221,271 | B2 | 5/2007 | Reime | |
| 9,474,122 | B2 * | 10/2016 | Kahlman | H05B 33/0845 |
| 2004/0233145 | A1 | 11/2004 | Chiang | |
| 2010/0194298 | A1 | 8/2010 | Kuwabara | |
| 2011/0273103 | A1 | 11/2011 | Hong | |
| 2014/0197751 | A1 * | 7/2014 | Grajcar | H05B 33/0809 315/192 |
| 2014/0375216 | A1 * | 12/2014 | Seidmann | H05B 33/0845 315/149 |

FOREIGN PATENT DOCUMENTS

| | | | |
|---|---|---|---|
| EP | 2385748 | A1 | 11/2011 |
| FR | 2901956 | A1 | 12/2007 |
| JP | 2009206037 | | 9/2009 |
| WO | 2009090597 | A1 | 7/2009 |
| WO | WO2010143362 | | 12/2010 |

* cited by examiner

METHOD AND DEVICE FOR LIGHTING A SPACE USING AN LED STRING

CROSS-REFERENCE TO RELATED APPLICATIONS

This patent application is a Continuation of U.S. patent application Ser. No. 14/004,745, filed Sep. 12, 2013, which claims the priority benefit under 35 U.S.C. §371 of international patent application no. PCT/IB2012/051147, filed Mar. 12, 2012, which claims the priority benefit of European Application No. 11158819.0 filed Mar. 18, 2011, the contents of which are herein incorporated by reference.

FIELD OF THE INVENTION

The present invention relates to the field of LED (Light Emitting Diode) lighting. More in particular, the present invention relates to a method and a device for lighting a space, using an LED string of LED segments connected in series.

BACKGROUND OF THE INVENTION

U.S. Pat. No. 7,081,722, US2010/0194298 and US2004/0233145 disclose a method and/or a circuit for driving LEDs in multiphase. A string of LEDs divided into groups connected to each other in series is provided. Each group is coupled to ground through separate conductive paths. A phase switch is provided in each conductive path. By increasing the input voltage, the string of LEDs are caused to turn on, group by group, in a sequence downstream the string.

In the field of LED lighting, a need exists to further enhance lighting functionality and to create specific spatially distributed lighting.

SUMMARY OF THE INVENTION

It would be desirable to provide a method and a device for lighting a space with spatially distributed lighting. It would also be desirable to provide spatially distributed lighting in a simple way and at reduced costs. Moreover it would be desirable to influence the distributed light by dimming.

To better address this concern, in a first aspect according to the invention a method of lighting at least part of a space is provided, using a light emitting diode (LED) string comprising a first LED segment and at least one further LED segment, which are connected in series, each LED segment comprising at least one LED, the LED string being powered by a rectified AC voltage. The first LED segment is powered when the rectified AC voltage is above a first voltage level, and the first LED segment and the further LED segment are powered when the rectified AC voltage is above a second voltage level higher than the first voltage level. The first LED segment is arranged to radiate light to a first volume of the space, and the further LED segment is arranged to radiate light to a second volume of the space, the first volume being at least partly different from the second volume. The first LED segment emits light having first light properties, and the further LED segment emits light having second light properties being equal to, or different from, the light properties of the first LED segment. The light properties may comprise light intensity and light color.

The LED string, hereinafter also referred to as LED module, comprises a plurality of LED segments connected in series. Each LED segment may comprise one or more LEDs mutually connected as desired. The voltage of each LED segment may be the same as, or different from, other segments. The number of LED segments in a LED string may be chosen differently, and is at least two.

The LED string may comprise LED segments all radiating light of the same color.

In other embodiments, one or more first LED segments may emit light having a first color temperature, and one or more further LED segments may emit light having a second color temperature. The first color temperature of light emitted by one first LED segment may differ from a first color temperature of light emitted by another first LED segment, and the second color temperature of light emitted by one further LED segment may differ from a second color temperature of light emitted by another further LED segment. The first LED segment may emit red, orange, yellow or amber light, including any combination thereof, and including saturated or less saturated colors.

When the AC voltage is not dimmed, both the first LED segment(s) and the further LED segment(s) are powered during a half cycle of the mains voltage, where the mains voltage will exceed both the first voltage level and the second voltage level.

When driving a string of LED segments as described above with an undimmed rectified AC voltage, the LED segments will operate according to the voltage level applied. In a half cycle of the mains voltage, when the momentary voltage rises, initially the first LED segment will be powered above the first voltage level to radiate light, and then additionally, when the momentary voltage rises further, (a) further LED segment(s) may be powered above the second voltage level to radiate light, while the further LED segment (s) and the first LED segment subsequently cease to radiate light when the momentary voltage falls below the second voltage level and the first voltage level, respectively. When the first LED segment and the further LED segment(s) are arranged to light first and second volumes, respectively, which are at least partly different from one another, a proportion of the light generated by the string of LED segments lights the first volume, and another proportion lights the second volume(s).

When the AC voltage is dimmed, both the duration of powering the first LED segment(s) and the duration of powering the further LED segment(s) during a half cycle of the mains voltage are reduced. When the AC voltage is dimmed such that the first voltage level is exceeded but the second voltage level is not exceeded during a half cycle of the mains voltage, only the first LED segment(s) will be powered during the half cycle. Consequently, the higher the dimming, the more the first LED segment(s) will dominate the intensity and/or color temperature of the light emitted by the LED string as a whole.

When the string of LED segments is dimmed, such as by phase-angle cutting of the AC voltage, or by decreasing the voltage amplitude, or by a combination thereof, the ratio of the proportions of the light generated by the string of LED segments lighting the first and second volume(s), respectively, will change automatically, that is to say, according to the inherent properties (e.g. forward operating voltage) of the LED segments and the respective driver circuit operation. This insight has led to the present invention, where the changing ratio is used to design a particular spatial light distribution while dimming, which is suitable for a specific purpose. In this design, a light intensity and light color generated by LED segments may be taken into account.

An LED module is dimmed when it operates at a lower mean voltage than the nominal voltage for which it is designed. As the voltage is decreased, the LED module power and the light output decrease accordingly. A variable voltage for dimming an LED module is produced by a dimming device coupled between an AC voltage and the LED module. The dimmer may be a device for varying the voltage amplitude, however, usually it is a solid-state switching device, switching the AC voltage on and off at the mains voltage frequency, thereby supplying power pulses to the LED module.

The dimmer may operate by phase-cut dimming, either by switching the voltage off during a first portion of a half cycle of the voltage, and switching the voltage on during a last portion of a half cycle of the voltage (also referred to as forward phase-cut dimming), or by switching the voltage on during a first portion of a half cycle of the voltage, and switching the voltage off during a last portion of a half cycle of the voltage (also referred to as reverse phase-cut dimming). Forward phase-cut dimming is cheap, and uses robust electronics. Reverse phase-cut dimming is more expensive and requires more complex electronics, but some loads, such as electronic transformers, operate better and generate less audible noise when this type of dimming is used.

When a user sets a level of dimming on the dimmer (input), a light level results (output). In most dimmers, the output of the dimmer is not directly proportional to the input. Different dimmers produce different dimmer curves defining the relationship between level of dimming and light level.

In an embodiment of the method of the present invention, the first volume at least partly overlaps the second volume. In the overlapping part, the light intensity, when both the first LED segment and the further LED segment are in operation to emit light, is highest, while outside the overlapping part light intensities are lower. This may provide a gradually decreasing light intensity away from the overlapping part. Additionally, or alternatively, in the overlapping part, the light color, when both the first LED segment and the further LED segment are in operation to emit light, may be different from the light color outside the overlapping part, when the color of the light radiated by the first LED segment is different from the color of the light radiated by the further LED segment.

In a second aspect of the invention, an LED module for lighting at least part of a space is provided, the LED module comprising a string which comprises a first LED segment and at least one further LED segment connected in series, wherein each LED segment comprises at least one LED. The first LED segment is adapted to be powered when the rectified AC voltage is above a first voltage level, and the first LED segment and the further LED segment are adapted to be powered when the rectified AC voltage is above a second voltage level higher than the first voltage level. The first LED segment is arranged to radiate light to a first volume of the space, and the further LED segment is arranged to radiate light to a second volume of the space, the first volume being at least partly different from the second volume.

In an embodiment of the LED module, the first LED segment is adapted to radiate light in a beam having a first direction, and the further LED segment is adapted to radiate light in a beam having a second direction different from the first direction. Here, a direction of a beam of light may be taken to be represented by a vector starting in the center of the associated LED segment, pointing away from said center, and being located centrally in the beam of light.

In an embodiment, the first direction is opposite to the second direction. The first direction may be downwards, and the second direction may be upwards in a specific application of the LED module. Such an arrangement may be used in a table lamp, where dimming of the LED module will result in decreasing the proportion of the light radiated upward by the LED module relative to the proportion of the light radiated downward by the LED module, thereby creating an increasingly intimate lighting atmosphere while increasing dimming.

In an embodiment of the LED module, the first LED segment and the further LED segment radiate light in beams having the same radiating direction. In such an embodiment, each beam may light a different volume, while all beams overlap.

In a further aspect of the invention, an LED lighting module is provided, the LED lighting module comprising the LED module of the invention. The LED lighting module further comprises an LED driver circuit comprising: LED driver input terminals adapted to be connected to a rectified AC voltage; a switching device connected in parallel to each further LED segment; a current control device connected between the LED driver input terminals; and control circuitry for controlling an open state or a closed state of each switching device. The control circuitry is adapted to control each switching device so as to be in a closed state when the rectified AC voltage is below a predetermined voltage level, and to control the switching device connected to a further LED segment to be in an open state when the rectified AC voltage is above the predetermined voltage level.

In a further aspect of the invention, an LED lighting module is provided, the LED lighting module comprising the LED module of the invention. The LED lighting module further comprises an LED driver circuit comprising: LED driver input terminals adapted to be connected to a rectified AC voltage; a switching device connected in parallel to the first LED segment, and a switching device connected in parallel to each further LED segment; a current control device connected between the LED driver input terminals; and control circuitry for controlling an open state or a closed state of each switching device. The control circuitry is adapted to control the switching device connected in parallel to the first LED segment so as to be in an open state and the switching device connected in parallel to a further LED segment so as to be in a closed state when the rectified AC voltage is above a first voltage level and below a second voltage level higher than the first voltage level, respectively, and to control the switching device connected to a further LED segment so as to be in an open state when the rectified AC voltage is above the second voltage level.

In a further aspect of the invention, an LED lighting module is provided, the LED lighting module comprising the LED module of the invention. The LED lighting module further comprises an LED driver circuit comprising: LED driver input terminals adapted to be connected to a rectified AC voltage; for each LED segment, a current control device connected between one terminal of the LED segment and an LED driver input terminal; and control circuitry for controlling a current in each current control device. The control circuitry is adapted to control the current control device of the first LED segment so as to allow a current to flow when the rectified AC voltage is above a first voltage level, and so as to disallow a current to flow when the rectified AC voltage is above a second voltage level higher than the first voltage level.

In an embodiment of one of the LED lighting modules, at least one of the current control devices is adapted to pulse-width modulate the current flowing through it to provide an additional LED segment light output control.

In a further aspect of the invention, a dimmable LED lighting module is provided, the dimmable LED lighting module comprising the LED lighting module of the invention, a rectifier and a dimming device.

These and other aspects of the invention will be more readily appreciated as the same becomes better understood by reference to the following detailed description and considered in connection with the accompanying drawings in which like reference symbols designate like parts.

DETAILED DESCRIPTION OF EMBODIMENTS

Figure 1A:
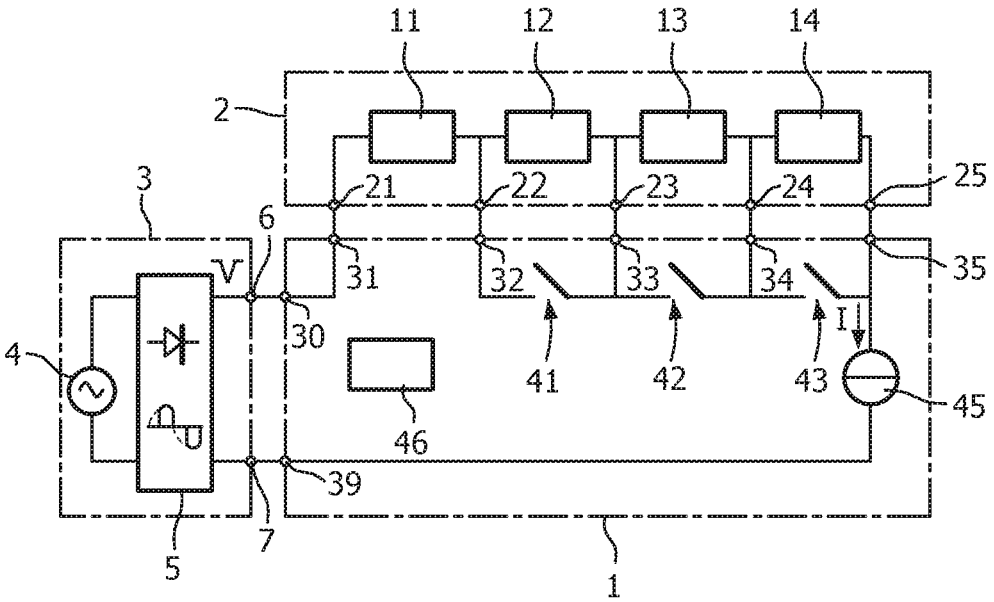
FIG. 1*a* depicts a diagram of a first embodiment of an LED lighting circuit in which different modules are indicated by dash-dotted lines.

FIG. 1*a* depicts an embodiment of an LED driver circuit 1 for driving a LED module 2. The LED driver circuit 1 is adapted to be coupled to a power supply 3 which may comprise an AC voltage supply 4 coupled to a rectifier and dimming device 5.

The power supply 3 has output terminals 6, 7 for supplying a rectified AC voltage according to the voltage amplitude and frequency used locally. The voltage supplied by the power supply 3 may be a forward phase-cut voltage or a reverse phase-cut voltage to provide a dimming function by varying the average voltage at the output terminals, depending on the cutting angle set automatically or by a user in the rectifier and dimming device 5.

The LED module 2 comprises a plurality of LED segments 11, 12, 13, 14 connected in series. Each LED segment 11, 12, 13, 14 may comprise one or more LEDs mutually connected as desired. The voltage of each LED segment 11, 12, 13, 14 may be the same as, or different from, other segments, for example about 30 V, about 36 V, or about 70 V. The number of LED segments in a LED module may be chosen to be different, and is at least two. The LED module 2 has terminals 21, 22, 23, 24, and 25, whereby each LED segment is accessible by two terminals. LED segment 11 has terminals 21 and 22, LED segment 12 has terminals 22 and 23, LED segment 13 has terminals 23 and 24, and LED segment 14 has terminals 24 and 25. Each of the terminals 21, 22, 23, 24 and 25 is available for coupling to a LED driver circuit 1.

The LED driver circuit 1 comprises a plurality of terminals 30, 31, 32, 33, 34, 35 and 39. Terminals 30 and 39 are adapted to be coupled to output terminals 6, 7 of the power supply 3. Terminals 31, 32, 33, 34 and 35 are adapted to be coupled to the terminals 21, 22, 23, 24 and 25, respectively, of the LED module 2. The LED driver circuit 1 comprises switching devices 41, 42 and 43 connected between terminals 32 and 33, 33 and 34, and 34 and 35, respectively. Examples of switching devices suitable for use in the LED driver circuit 1 are switchable transistors, such as field effect transistors or bipolar transistors. A current control device 45 is connected between terminals 35 and 39 of the LED driver circuit 1. The LED driver circuit 1 further comprises control circuitry 46 operatively connected to the switching devices 41, 42 and 43 for, in use, bringing the switching devices 41, 42 and 43 into an open state (non-conducting) or a closed state (conducting) at a desired timing. An example of such timed operation is given below. The control circuitry 46 may further optionally be operatively connected to the current control device 45 to, in use, control the current flowing through the current control device 45 at a desired timing, which may also be pulse-width modulation.

It is noted that in an alternative embodiment, the rectifier and dimmer device 5 may be part of the LED driver circuit 1.

The combination of the LED driver circuit 1 and the LED module 2 will be referred to as LED lighting module.

Figure 1B:
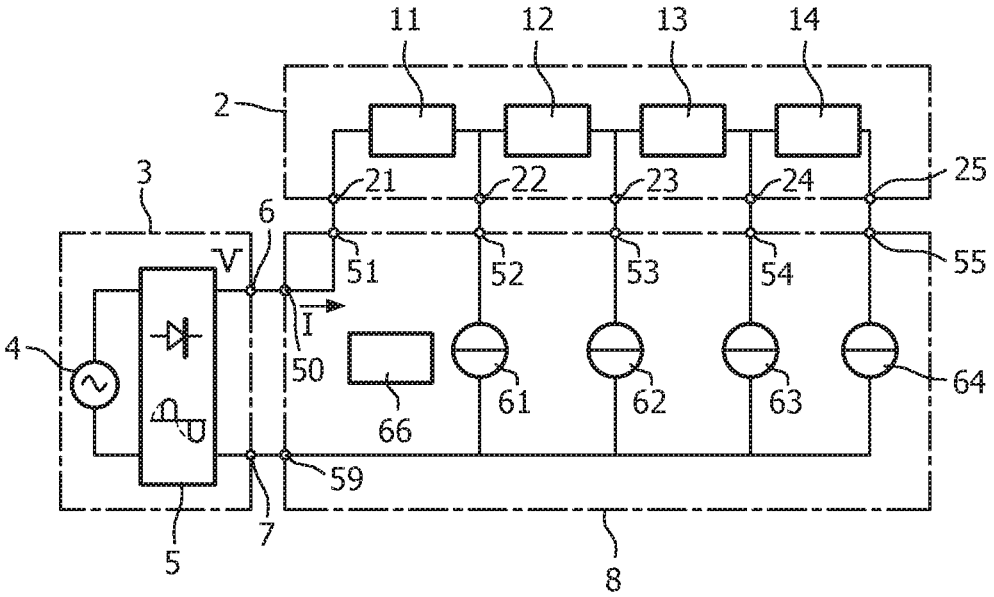
FIG. 1*b* depicts a diagram of a second embodiment of an LED lighting circuit in which different modules are indicate by dash-dotted lines.

FIG. 1*b* depicts an embodiment of an LED driver circuit 8 for driving the LED module 2 from the power supply 3. The configuration of the LED module 2 and the power supply 3 may be similar or identical to the configurations as explained with reference to FIG. 1*a*, and the same reference numerals have been used to identify components thereof.

The LED driver circuit 8 comprises a plurality of terminals 50, 51, 52, 53, 54, 55 and 59. Terminals 50 and 59 are adapted to be coupled to output terminals 6, 7 of the power supply 3. Terminals 51, 52, 53, 54 and 55 are adapted to be coupled to the terminals 21, 22, 23, 24 and 25, respectively, of the LED module 2. The LED driver circuit 8 comprises a plurality of current control devices 61, 62, 63 and 64 connected between terminals 52 and 59, 53 and 59, 54 and 59, and 55 and 59, respectively. The LED driver circuit 8 may further optionally comprise control circuitry 66 operatively connected to the current control devices 61, 62, 63 and 64 to, in use, control the current flowing through each of the current control devices 61, 62, 63, 64. An example of such operation is given below.

An LED segment 11, 12, 13, 14 emits a distinct color of light, when in use. The following colors of light are distinguished:

- cold white (CW) light having a high color temperature, e.g. of about 5,000 K;
- neutral white or normal white (NW) light having a color temperature lower than cold white, e.g. of about 4,000 K;
- warm white (WW) light, such as yellow or orange light, having a color temperature lower than NW;
- amber (AM) light having a color temperature lower than WW;
- red (RD) light having a color temperature lower than AM.

In the LED module 2, all LED segments may emit the same color of light. In other embodiments, at least one of the LED segments may emit NW light, WW light, AM light and/or RD light, and at least another one of the other LED segments may emit CW light, NW light (when the at least one of the LED segments does not emit NW light) and/or WW light (when the at least one of the LED segments does not emit NW or WW light). Thus, the following combinations of light emitted by different LED segments 11, 12, 13 and 14 may be present according to Table I below, where X indicates a combination of the light in the same column and row:

TABLE 1

| | color combinations in LED module | | | |
|---|---|---|---|---|
| | NW | WW | AM | RD |
| CW | X | X | X | X |
| NW | | X | X | X |
| WW | | | X | X |

Figure 2:
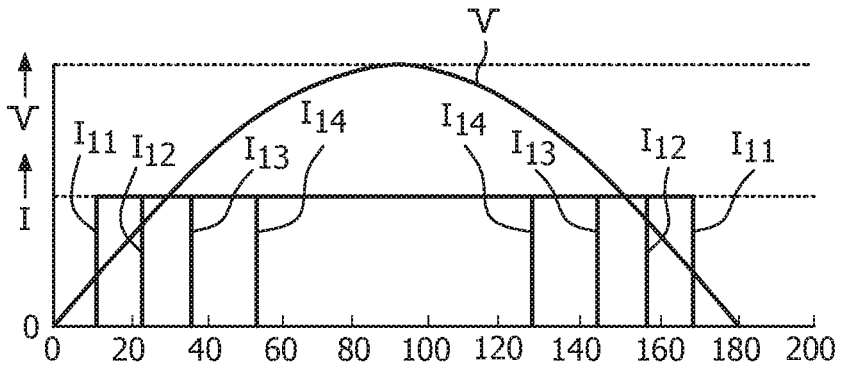
FIG. 2 depicts currents in different LED segments, as a function of the phase angle in a half cycle of the (rectified) AC voltage in the LED lighting circuit according to FIG. 1*a*.

FIG. 2 illustrates an operation of an embodiment of the circuit of FIG. 1*a*, wherein LED segment 11 may emit WW or RD or AM or RD/AM light, and at least one of the other LED segments 12, 13 and 14 may emit light having a higher color temperature than LED segment 11. In other embodiments, the color temperature of the light emitted by the LED segments 11, 12, 13 and 14 may be the same. The mode of operation is constant current delivered by the power supply 3. In this mode of operation, the current through the LED segments is not adjusted as a function of the number of LED segments turned on.

In FIG. 2, curve V represents the rectified mains voltage V. As shown by curve V, in a half cycle (phase angle running from 0-180 degrees) of the rectified mains voltage, the amplitude of the voltage V increases from zero value at 0 degrees to a top value at 90 degrees, and recedes back to zero value at 180 degrees.

It is assumed that all LED segments 11, 12, 13, 14 have about the same on-voltage. It is further assumed that at 0 degrees all switching devices 41, 42 and 43 are in a closed state, or that at least one of the switching devices 41, 42 and 43 is in an open state.

When the voltage V increases from 0 degrees onwards, at about 11 degrees the voltage V is at a first level sufficient for a current I, amplitude-controlled by the current control device 45, to run in the LED segment 11. All switching devices 41, 42 and 43 should then be in a closed state, or be brought into a closed state, and the current I will flow through the LED segment 11, the closed switches 41, 42 and 43, and the current control device 45. The value of the current I flowing through the LED segment 11 is indicated by I11.

At about 23 degrees, the voltage V is at a second level sufficient for the LED segments 11 and 12 to be conducting, and for the current I, still controlled in amplitude by the current control device 45, to run in the series-connected LED segments 11 and 12. The switching device 41 should then be brought into an open state, while the switching devices 42 and 43 remain in a closed state, to allow the current I, already flowing through LED segment 11, to run also in LED segment 12. The current flowing through LED segment 12 is indicated by I12.

At about 36 degrees, the voltage V is at a third level sufficient for the LED segments 11, 12 and 13 to be conducting, and for the current I, still controlled in amplitude by the current control device 45, to run in the series-connected LED segments 11, 12 and 13. The switching device 41 should then remain in an open state, while the switching device 42 should be brought into an open state, and the switching device 43 should remain in a closed state, to allow the current I, already flowing through LED segments 11 and 12, to run also in LED segment 13. The current flowing through LED segment 13 is indicated by I13.

At about 52 degrees, the voltage V is at a fourth level sufficient for the LED segments 11, 12, 13 and 14 to be conducting, and for the current I, still controlled in amplitude by the current control device 45, to run in the series-connected LED segments 11, 12, 13 and 14. The switching devices 41 and 42 should then remain in an open state, and the switching device 43 should be brought into an open state, to allow the current I, already flowing through LED segments 11, 12 and 13, to run also in LED segment 14. The current flowing through LED segment 14 is indicated by I14.

Between about 52 and about 128 degrees, the voltage V remains above the fourth level sufficient for the LED segments 11, 12, 13 and 14 to be conducting, and for the current I, still controlled in amplitude by the current control device 45, to run in the series-connected LED segments 11, 12, 13 and 14. All switching devices 41, 42 and 43 remain open.

At about 128 degrees, the voltage V decreases to below the fourth level, and becomes insufficient for the LED segment 14 to be conducting, but is still sufficient for the LED segments 11, 12 and 13 to be conducting, and for the current I, still controlled in amplitude by the current control device 45, to run in the series-connected LED segments 11, 12 and 13. The switching device 43 should then be brought into a closed state, while the switching devices 41 and 42 remain in an open state, to allow the current I to continue to run in the LED segments 11, 12 and 13. Current I14 becomes zero.

At about 144 degrees, the voltage V decreases to below the third level, and becomes insufficient for the LED segment 13 to be conducting, but is still sufficient for the LED segments 11 and 12 to be conducting, and for the current I, still controlled in amplitude by the current control device 45, to run in the series-connected LED segments 11 and 12. The switching device 42 should then be brought into a closed state, while the switching device 41 remains in an open state and the switching device 43 remains in a closed state, to allow the current I to continue to run in the LED segments 11 and 12. Current I13 becomes zero.

At about 157 degrees, the voltage V decreases to below the second level, and becomes insufficient for the LED segment 12 to be conducting, but is still sufficient for the LED segment 11 to be conducting, and for the current I, still controlled in amplitude by the current control device 45, to run in LED segment 11. The switching device 41 should then be brought into a closed state, while the switching devices 42 and 43 remain in a closed state, to allow the current I to continue to run in the LED segment 11. Current I12 becomes zero.

At about 169 degrees, the voltage V decreases to below the first level, and becomes insufficient for the LED segment 11 to be conducting. Current I11 becomes zero.

After about 169 degrees, each of the switching devices may be in an open or closed state. The voltage V is insufficient to have a current I flowing in any of the LED segments 11, 12, 13 or 14.

Figure 3:
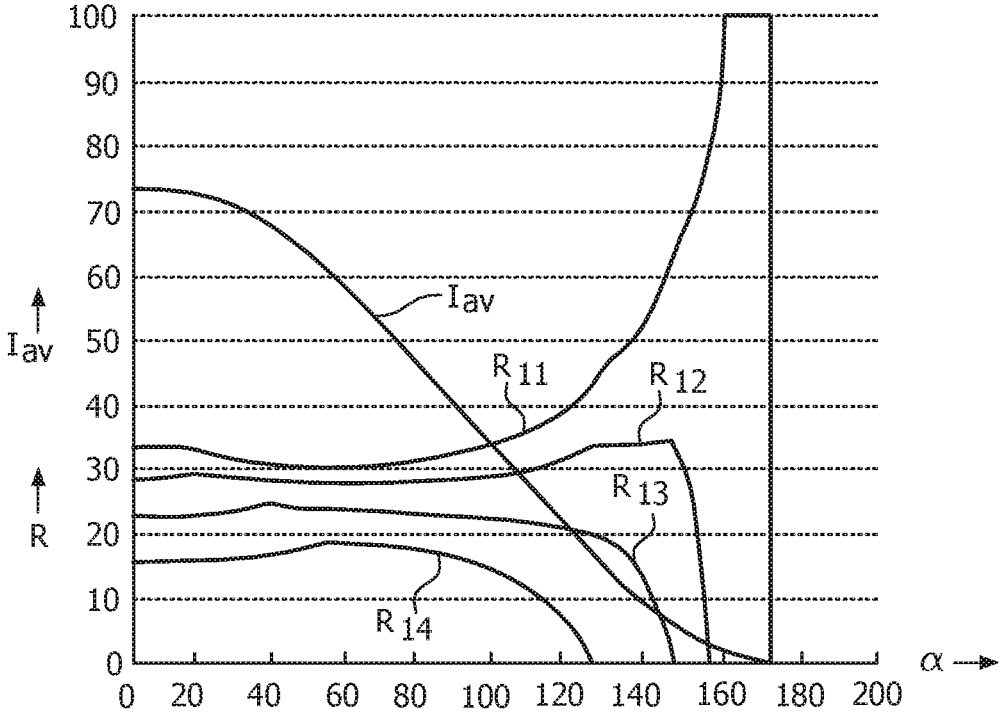
FIG. 3 depicts simulation results of ratios of the light output of the different LED segments compared with the total light output of all LED segments, and average current, at a variation of a phase-cutting angle $\alpha$ of the (rectified) AC voltage in the LED lighting circuit according to FIG. 1*a* at the currents depicted in FIG. 2.

FIG. 3 illustrates the ratios R of the light output of the LED segments 11 (ratio R11), 12 (ratio R12), 13 (ratio R13) and 14 (ratio R14) compared with the total light output of the LED module 2 (vertical axis) at a variation of a phase-cutting angle α of the AC voltage (horizontal axis) in the rectifier and dimming device 5, for each LED segment 11, 12, 13, 14. At every phase-cutting angle α, the following equation holds true: R11+R12+R13+R14=100%.

If the phase-cutting angle α is 0 degrees (no phase cutting), then the ratio R11 of the light output of LED segment 11 to the total light output of the LED module 2 as seen over a half cycle of the AC voltage, is about 33%. For LED segments 12, 13 and 14, the ratios R12, R13 and R14 are about 28%, 23% and 16%, respectively.

As can be understood from FIG. 2, and can be seen in FIG. 3, the ratios R11, R12, R13 and R14 remain the same when the phase-cutting angle α is between 0 degrees and 11 degrees, since it does not affect the conduction times of any of the LED segments. As can further be understood from FIG. 2, and can be seen in FIG. 3, the ratio R14 becomes zero when the phase-curring angle α is greater than 128 degrees, since LED segment 14 cannot conduct at such phase-cutting angles α. When the phase-cutting angle α is greater than 144 degrees, the ratio R13 becomes zero, since LED segment 13 cannot conduct at such phase-cutting angles α. When the phase-cutting angle α is greater than 157 degrees, the ratio R12 becomes zero, since LED segment 12 cannot conduct at such phase-cutting angles α. When the phase-cutting angle α is between 157 and 169 degrees, the ratio R11 becomes 100%, since LED segment 11 is the only one which would come into a conducting state during a half cycle of the voltage V. When the phase-cutting angle α is greater than 169 degrees, the ratio R11 becomes zero, since LED segment 11 cannot conduct at such phase-cutting angles α. In fact, none of the LED segments 11, 12, 13 or 14 can conduct when the phase-cutting angle α is greater than 169 degrees.

In FIG. 3, curve lay shows the average current through the LED segments 11, 12, 13, 14 at different phase-cutting angles α.

Figure 4:
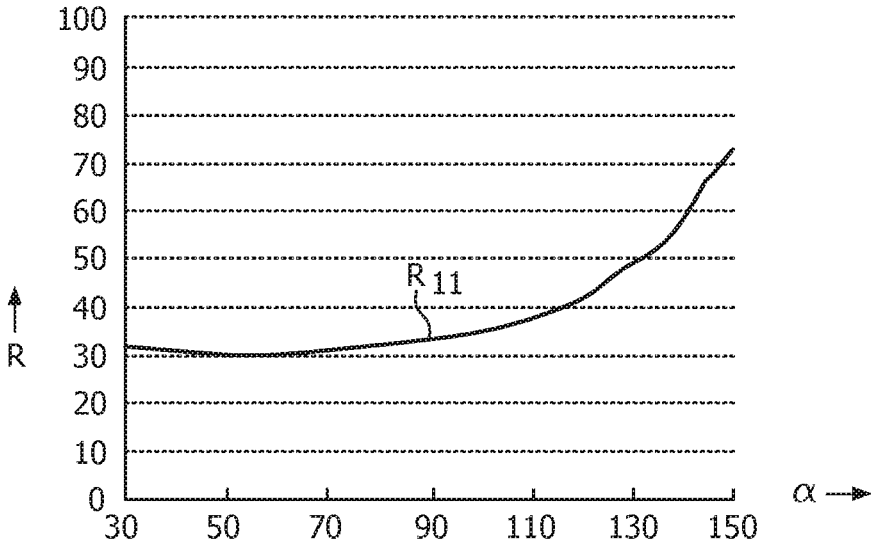
FIG. 4 depicts a detail of FIG. 3.

FIG. 4 shows a detail of FIG. 3, i.e. curve R11 for phase-cutting angles between 30 degrees and 150 degrees, which is a typical operating range for a rectifier and dimming device 5. As illustrated by FIG. 3, for LED segments 12, 13 and 14, the respective ratios R12, R13 and R14 remain substantially the same, or decrease, when the phase-cutting angle α increases within the operating range of FIG. 4. However, the ratio R11 increases significantly when the phase-cutting angle α increases within the operating range of FIG. 4.

If the color temperature of the light emitted by the LED segment 11 is lower than the color temperature of at least one of the other LED segments 12, 13, 14, then the effect of dimming the LED string of the LED module 2 is that the color temperature of the light emitted by the LED segment 11 and at least LED segment 12 of the LED module 2 may decrease when the phase-cutting angle α increases, due to the LED segment 11 becoming dominant over one or more of the other LED segments 12, 13, 14, or in other words: the ratio R11 increases more than any of the ratios R12, R13, R14. As a result, when dimming the LED module 2, the (overall) color temperature of the light emitted by LED segment 11 and one or more of the LED segments 12, 13 and 14 may exhibit a decrease similar to that of an incandescent lamp. The user of the LED module may perceive a color behavior which resembles a BBL (black body line) behavior.

As an example, at least the LED segment 11 may emit RD light, or RD/AM light, whereas at least one of the other LED segments 12, 13 and 14 may emit WW, NW and/or CW light.

In alternative embodiments, all LED segments may emit light having the same color temperature.

Figure 5:
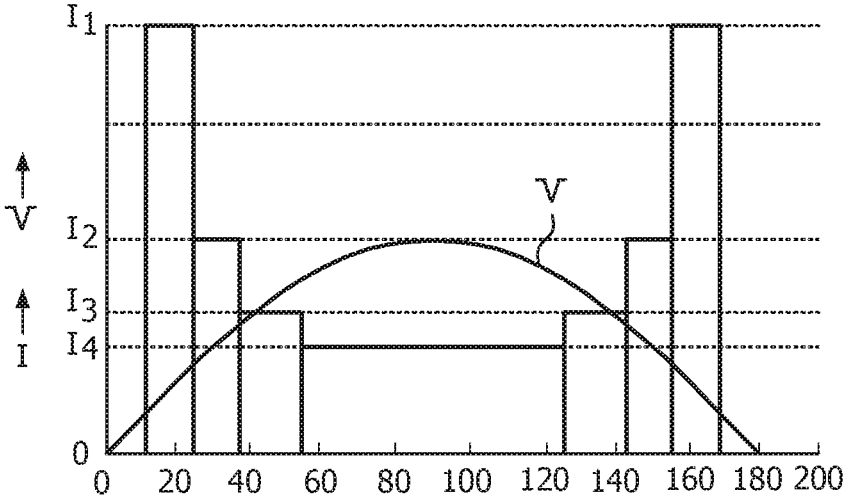
FIG. 5 depicts currents in different LED segments, as a function of the phase angle in a half cycle of the (rectified) AC voltage in the LED lighting circuit according to FIG. 1*b*.

FIG. 5 illustrates an operation of an embodiment of the circuit of FIG. 1*b*, wherein the LED segment 11 may emit WW or RD or AM or RD/AM light, and at least one of the LED segments 12, 13 and 14 may emit light having a higher color temperature than the LED segment 11. In other embodiments, the color temperature of the light emitted by the LED segments 11, 12, 13 and 14 may be the same. The mode of operation is constant power delivered by the power supply 3. In this mode of operation, the current through the LED segments is adjusted as a function of the number of LED segments turned on.

In FIG. 5, curve V represents a half cycle (phase angle running from 0-180 degrees) of the rectified mains voltage V.

It is assumed that all LED segments 11, 12, 13, 14 have about the same on-voltage.

When the voltage V increases from 0 degrees onwards, at about 11 degrees the voltage V is at a first level sufficient for a current I having a value 11, amplitude-controlled by current control device 61, to run in LED segment 11. No current flows in the other LED segments 12, 13, 14.

At about 23 degrees, the voltage V is at a second level sufficient for the LED segments 11 and 12 to be conducting. The current I is adjusted to have a value 12, amplitude-controlled by current control device 62, to run in series-connected LED segments 11 and 12. Current control device 61 is controlled by control circuitry 66 not to conduct current. No current flows in the other LED segments 13 and 14.

At about 36 degrees, the voltage V is at a third level sufficient for the LED segments 11, 12 and 13 to be conducting. The current I is adjusted to have a value 13, amplitude-controlled by current control device 63, to run in series-connected LED segments 11, 12 and 13. Current control devices 61 and 62 are controlled by control circuitry 66 not to conduct current. No current flows in the LED segment 14.

At about 52 degrees, the voltage V is at a fourth level sufficient for the LED segment 11, 12, 13 and 14 to be conducting. The current is adjusted to have a value 14, amplitude-controlled by current control device 64, to run in series-connected LED segments 11, 12, 13 and 14. Current control devices 61, 62 and 63 are controlled by control circuitry 66 not to conduct current.

Between about 52 and about 128 degrees, the voltage V remains above the fourth level sufficient for the LED segments 11, 12, 13 and 14 to be conducting, and for the current I, still controlled in amplitude by the current control device 64, to run in the series-connected LED segments 11, 12, 13 and 14. All current control devices 61, 62 and 63 are in an open state, i.e. do not conduct current.

At about 128 degrees, the voltage V decreases below the fourth level, and becomes insufficient for the LED segment 14 to be conducting, but is still sufficient for the LED segments 11, 12 and 13 to be conducting, and for the current I to run in the series-connected LED segments 11, 12 and 13. The current control device 63 then adjusts the amplitude of the current I to have a value 13. Current control devices 61 and 62 are controlled by control circuitry 66 not to conduct current.

At about 144 degrees, the voltage V decreases below the third level, and becomes insufficient for the LED segments 13 and 14 to be conducting, but is still sufficient for the LED segments 11 and 12 to be conducting, and for the current I to run in the series-connected LED segments 11 and 12. The current control device 62 then adjusts the amplitude of the current I to a value 12. Current control device 61 is controlled by control circuitry 66 not to conduct current.

At about 157 degrees, the voltage V decreases below the second level, and becomes insufficient for the LED segments 12, 13 and 14 to be conducting, but is still sufficient for the LED segment 11 to be conducting, and for the current I to run in LED segment 11. The current control device 61 then adjusts the amplitude of the current I to a value 11.

At about 169 degrees, the voltage V decreases below the first level, and becomes insufficient for LED segment 11 to be conducting. Current I becomes zero.

Beyond about 169 degrees, the voltage V is insufficient to have a current I flow in any of the LED segments 11, 12, 13 or 14.

Figure 6:
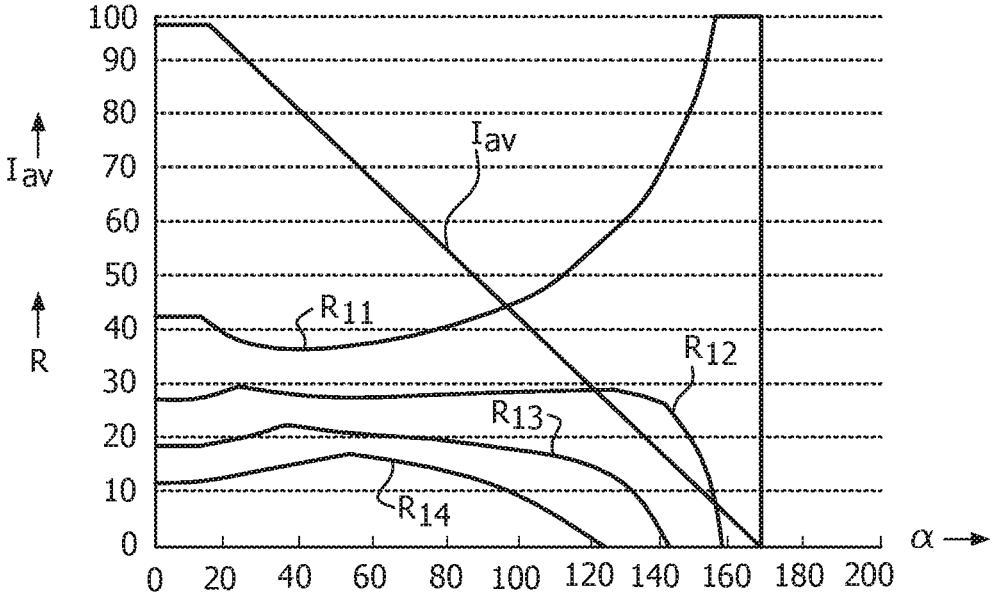
FIG. 6 depicts simulation results of ratios of the light output of the different LED segments compared with the total light output of all LED segments, and average current, at a variation of a phase-cutting angle $\alpha$ of the (rectified) AC voltage in the LED lighting circuit according to FIG. 1*b* at the currents depicted in FIG. 5.

FIG. 6 illustrates the ratios R of the light output of the LED segments 11 (ratio R11), 12 (ratio R12), 13 (ratio R13) and 14 (ratio R14) compared with the total light output of the LED module 2 (vertical axis) at a variation of a phase-cutting angle α of the AC voltage (horizontal axis) in the rectifier and dimming device 5, for each LED segment 11, 12, 13, 14. At every phase-cutting angle α, the following equation holds true: R11+R12+R13+R14=100%.

If the phase-cutting angle α is 0 degrees (no phase cutting), then the ratio R11 of the light output of LED segment 11 to the total light output of the LED module 2 as seen over a half cycle of the AC voltage, is about 42%. For LED segments 12, 13 and 14, the ratios R12, R13 and R14 are about 27%, 19% and 12%, respectively.

As can be understood from FIG. 5, and can be seen in FIG. 6, the ratios R11, R12, R13 and R14 remain the same when the phase-cutting angle α is between 0 degrees and 11 degrees, since at these values it does not affect the conduction times of any of the LED segments. As can further be understood from FIG. 5, and can be seen in FIG. 6, the ratio R14 becomes zero when the phase-curring angle α is greater than 128 degrees, since LED segment 14 cannot conduct at such phase-cutting angles α. When the phase-cutting angle α is greater than 144 degrees, the ratio R13 becomes zero, since LED segment 13 cannot conduct at such phase-cutting angles α. When the phase-cutting angle α is greater than 157 degrees, the ratio R12 becomes zero, since LED segment 12 cannot conduct at such phase-cutting angles α. When the phase-cutting angle α is between 157 and 169 degrees, the ratio R11 becomes 100%, since LED segment 11 is the only one which would come into a conducting state during a half cycle of the voltage V. When the phase-cutting angle α is greater than 169 degrees, the ratio R11 becomes zero, since LED segment 11 cannot conduct at such phase-cutting angles α. In fact, none of the LED segments 11, 12, 13 or 14 can conduct when the phase-cutting angle α is greater than 169 degrees.

In FIG. 6, curve lay shows the average current through the LED segments 11, 12, 13, 14 at different phase-cutting angles α.

It follows from FIG. 6 that the effect of dimming the LED string of the LED module 2 is that the color temperature of the light emitted by the LED module 2 may decrease when the phase-cutting angle α increases, due to the LED segment 11 becoming dominant over the other LED segments 12, 13, 14, or in other words: the ratio R11 increases more than any of the ratios R12, R13, R14. As a result, when dimming the LED module 2, the (overall) color temperature of the light emitted by LED segment 11 and one or more of the LED segments 12, 13 and 14 may decrease in a way similar to an incandescent lamp.

Figure 7:
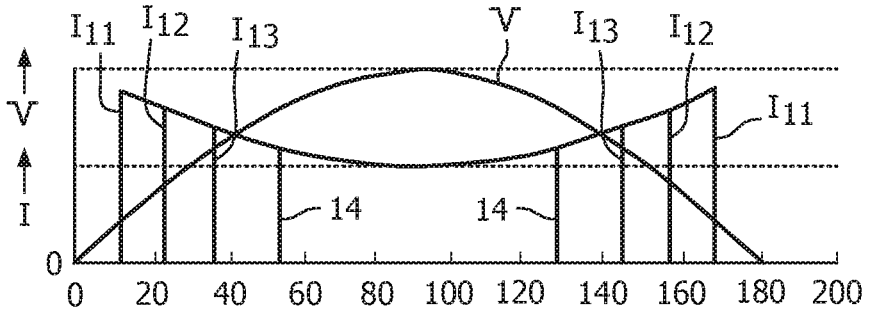
FIG. 7 depicts currents in different LED segments, as a function of the phase angle in a half cycle of the (rectified) AC voltage in the LED lighting circuit according to FIG. 1*a*.

FIG. 7 illustrates an operation of an embodiment of the circuit of FIG. 1*a*, wherein the LED segment 11 may emit WW or RD or AM or RD/AM light, and at least one of the LED segments 12, 13 and 14 may emit light having a higher color temperature than the LED segment 11. In other embodiments, the color temperature of the light emitted by the LED segments 11, 12, 13 and 14 may be the same. The mode of operation delivers 50% modulated LED segment current by the power supply 3. In this mode of operation, the current through the LED segments varies over a half cycle of the voltage V.

In FIG. 7, curve V represents a half cycle (0-180 degrees) of the rectified mains voltage V.

It is assumed that all LED segments 11, 12, 13, 14 have about the same on-voltage.

For a description of the circuit of FIG. 1*a* in the mode of operation illustrated in FIG. 7, reference is made to the description of FIG. 3 above, where the only difference is that once a current I flows through an LED segment, it is 50% pulse width modulated.

Figure 8:
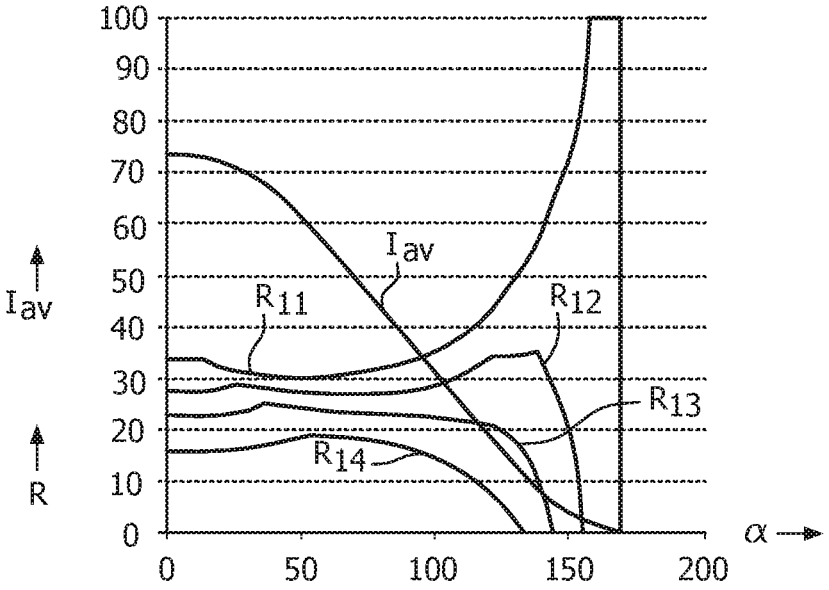
FIG. 8 depicts simulation results of ratios of the light output of the different LED segments compared with the total light output of all LED segments, and average current, at a variation of a phase-cutting angle $\alpha$ of the (rectified) AC voltage in the LED lighting circuit according to FIG. 1*a* at the currents depicted in FIG. 7.

FIG. 8 illustrates the ratios R of the light output of the LED segments 11 (ratio R11), 12 (ratio R12), 13 (ratio R13) and 14 (ratio R14) compared with the total light output of the LED module 2 (vertical axis) at a variation of a phase-cutting angle α of the AC voltage (horizontal axis) in the rectifier and dimming device 5, for each LED segment 11, 12, 13, 14. At every phase-cutting angle α, the following equation holds true: R11+R12+R13+R14=100%.

When the phase-cutting angle α is 0 degrees (no phase cutting), the ratio R11 of the light output of LED segment 11 in the total light output of the LED module 2 as seen over a half cycle of the AC voltage, is about 33%. For LED segments 12, 13 and 14, the ratios R12, R13 and R14 are about 28%, 23% and 16%, respectively.

As can be understood from FIG. 7, and can be seen in FIG. 8, the ratios R11, R12, R13 and R14 remain the same when the phase-cutting angle α is between 0 degrees and 11 degrees, since at these values it does not affect the conduction times of any of the LED segments. As can further be understood from FIG. 7, and can be seen in FIG. 8, the ratio R14 becomes zero when the phase-cutting angle α is greater than 128 degrees, since LED segment 14 cannot conduct at such phase-cutting angles α. When the phase-cutting angle α is greater than 144 degrees, the ratio R13 becomes zero, since LED segment 13 cannot conduct at such phase-cutting angles α. When the phase-cutting angle α is greater than 157 degrees, the ratio R12 becomes zero, since LED segment 12 cannot conduct at such phase-cutting angles α. When the phase-cutting angle α is between 157 and 169 degrees, the ratio R11 becomes 100%, since LED segment 11 is the only one which would come into a conducting state during a half cycle of the voltage V. When the phase-cutting angle α is greater than 169 degrees, the ratio R11 becomes zero, since LED segment 11 cannot conduct at such phase-cutting angles α. In fact, none of the LED segments 11, 12, 13 or 14 can conduct when the phase-cutting angle α is greater than 169 degrees.

In FIG. 8, curve lay shows the average current through the LED segments 11, 12, 13, 14 at different phase-cutting angles α.

It follows from FIG. 8 that the effect of dimming the LED string of the LED module 2 is that the color temperature of the light emitted by the LED module 2 may decrease when the phase-cutting angle α increases, due to the LED segment 11 becoming dominant over the other LED segments 12, 13, 14, or in other words: the ratio R11 increases more than any of the ratios R12, R13, R14. As a result, when dimming the LED module 2, the (overall) color temperature of the light emitted by the LED segment 11 and one or more of the LED segments 12, 13 and 14 may decrease in a way similar to an incandescent lamp.

When comparing FIGS. 3 (in conjunction with 4), 6 and 8, it appears that in all three scenarios, for LED segments 12, 13 and 14, the respective ratios R12, R13 and R14 remain substantially the same, or decrease, in a representative operating range of the phase-cutting angle α, such as the operating range illustrated in FIG. 4. However, the ratio R11 increases significantly when the phase-cutting angle α increases within the operating range. The ratio R11 may additionally be adjusted by adjusting the current flowing through LED segment 11 by a predetermined control of the current control devices 45 (FIGS. 1*a*, 2, 3, 4, 7 and 8) or 61 (FIGS. 1*b*, 5 and 6), respectively, possibly supplemented by a predetermined control of the current control devices 62, 63 and/or 64 (FIGS. 1*b*, 5 and 6).

It is noted that the LED driver circuit 1 in FIG. 1*a* has switching devices 41, 42 and 43 which are adapted so as to be connected in parallel with respective LED segments 12, 13 and 14. For LED segment 11, there is no respective switching device. However, in an alternative embodiment of the LED driver circuit 1, a switching device may be connected in parallel with LED segment 11, and operatively connected to control circuitry 46 for opening and closing the switching device in a controlled manner. In such circumstances, when the voltage V is at a first level, any of the LED segments 11, 12, 13, 14 may be selected to conduct current I, by bringing its respective switching device into an open state. This means that the LED segment 11, in that case, does not need to be the first LED segment to be conducting, and does not need to emit light having a color temperature which is lower than the color temperature of at least one of the other LED segments. The first LED segment to be conducting and to emit light having a color temperature lower than the color temperature of at least one of the other LED segments may be selected to be any of the LED segments 11, 12, 13 or 14, when the LED driver circuit has a switching device adapted to be connected in parallel to each one of the LED segments. In other embodiments, the color temperature of all LED segments may be the same.

In the above description of operations of the LED driver circuits 1 and 8, as shown in FIGS. 1*a* and 1*b*, respectively, it has been assumed that all LED segments have about the same on-voltage, i.e. the voltage at which the LED segment starts to conduct current. However, different LED segments may have different on-voltages, which will influence the phase angles at which the LED segment concerned may start or stop to conduct and emit light.

Figure 9:
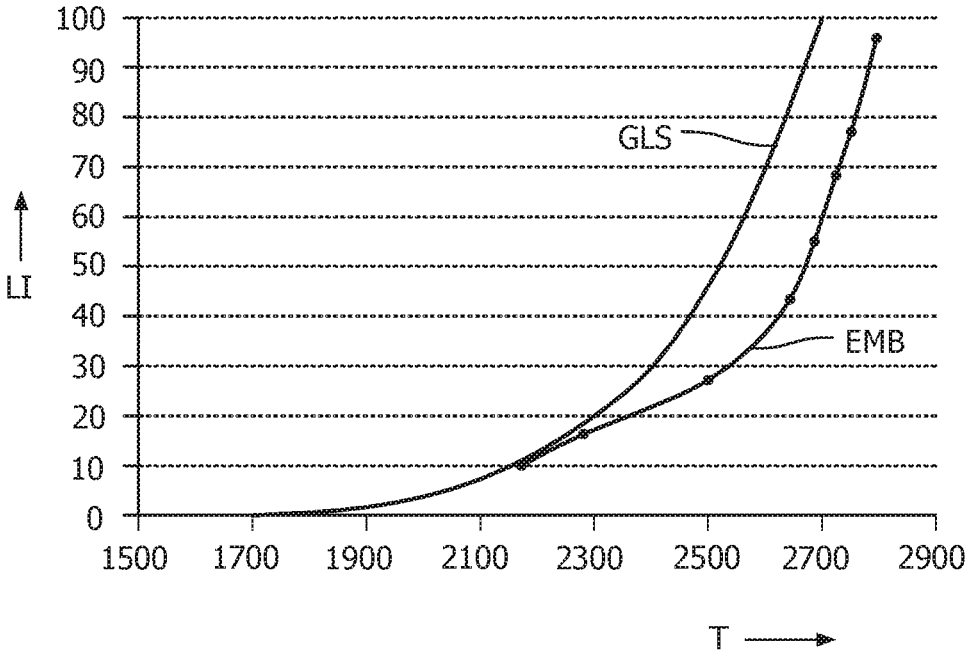
FIG. 9 depicts measured graphs of color temperature versus light intensity for an embodiment of an LED string, and for a GLS (incandescent lamp).

FIG. 9 shows a first graph, marked EMB, of measurements of the color temperature T (K) of an embodiment of a LED module comprising six LED segments of 50 V each, where the first LED segment emits amber light, and the other five LED segments emit white light, plotted against the light intensity LI (%) of the LED module over a dimming range. For comparison, the color temperature of a common GLS (incandescent lamp) is plotted against its light intensity in the same diagram. As can be seen, both for the LED module and the GLS, the color temperature of the emitted light as a whole decreases in a similar way, demonstrating that the LED module as a whole shows a similar behaviour of the color temperature of its emitted light as a GLS.

Figure 10:
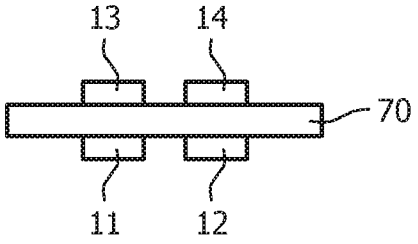
FIG. 10 schematically depicts (part of) a lighting module comprising four LED segments of an LED string.

FIG. 10 shows an LED module having a support 70 on which four (4) LED segments 11, 12, 13 and 14 are mounted. The LED segments 11, 12, 13 and 14 may be part of an LED module 2 as depicted in FIG. 1*a* or 1*b*. The LED segments 11, 12, 13 and 14 are connected in series, and may each comprise one or more LEDs mutually connected as desired (series, parallel, or series-parallel). The operating voltage of each LED segment 11, 12, 13, 14 may be the same as, or different from, other segments, for example about 30 V, about 36 V, or about 70 V. The number of LED segments in a LED module may be chosen differently, and is at least two. In the arrangement of FIG. 10, the color and/or the intensity of the light emitted by each of the LED segments 11, 12, 13 and 14 at a normal operating voltage may be the same as one or more of the other LED segments, or different therefrom, as explained above.

For the following explanation, it is assumed that LED segments 11 and 12 on the support 70 of the LED module of FIG. 10 radiate light downwards, while LED segments 13 and 14 of the LED module of FIG. 10 radiate light upwards.

Figure 11:
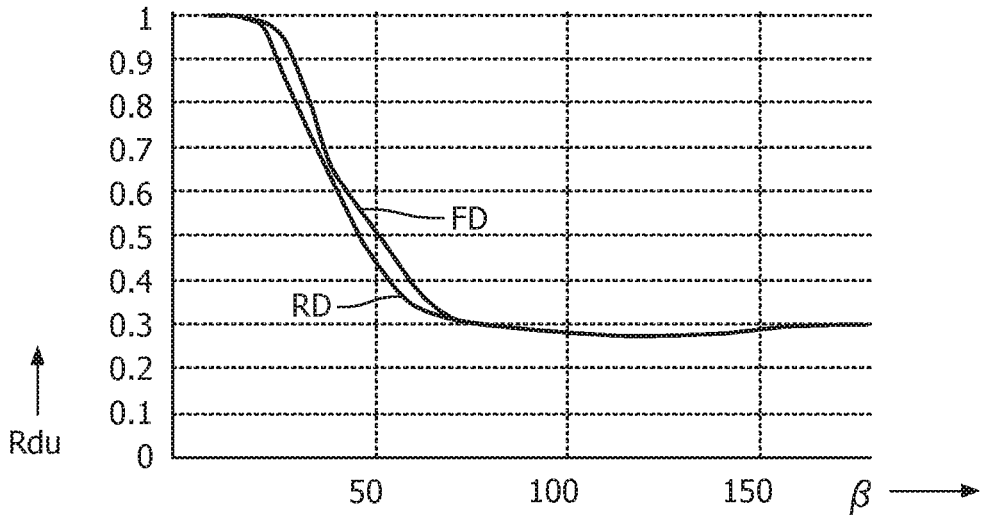
FIG. 11 depicts curves illustrating a relationship between a phase-cutting angle of the AC voltage in an LED lighting module, and a ratio between radiation from LED segments radiating in one direction, and radiation from LED segments radiating in another direction.

When the LED segments 11, 12, 13 and 14 are included in an LED lighting circuit as shown in FIG. 1*a* or 1*b*, and operated by a phase-cut voltage in a dimming operation, e.g. as explained by reference to FIG. 3 or FIG. 6, respectively, a ratio Rdu of the intensity of light radiated downwards (by the LED segments 13, 14) to the intensity of light radiated upwards (by the LED segments 11, 12) may be measured as a function of a conduction angle β (where $\beta=180°-\alpha$, with a being a phase-cut angle in forward (leading edge) phase-cut dimming or in reverse (trailing edge) phase-cut dimming). A result of such measurements is shown in the graphs of FIG. 11, where the curve marked FD has been obtained for forward phase-cut dimming, and the curve marked RD has been obtained for reverse phase-cut dimming. Both curves show that at a relatively small amount of dimming, i.e. large (e.g. more than 70°) conduction angles β (corresponding to phase-cut angles e.g. smaller than 110°), the proportion of light radiated downwards compared to the proportion of light radiated upwards may be relatively constant. However, with decreasing conduction angles β (corresponding to increasing phase-cut angles α), the ratio of light radiated downwards to light radiated upwards increases such that most light is radiated downwards.

Figure 12:
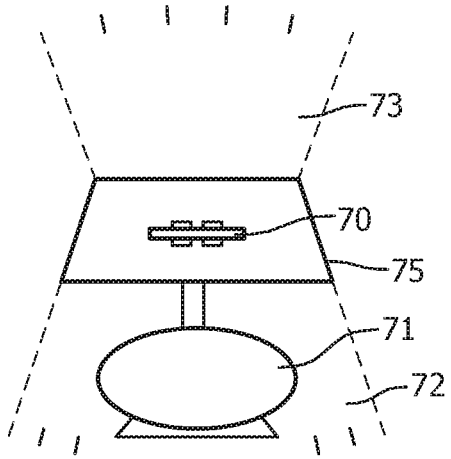
FIG. 12 schematically depicts a lighting device, in particular a side view of a table lamp comprising a lighting module similar to the one of FIG. 10.

As illustrated in FIG. 12, when the LED module of FIG. 10 is operated as illustrated in FIG. 11, a table lamp 71 having a lampshade 75 comprising a support 70 carrying the LED segments 11, 12, 13, 14, may radiate a beam of light 72 downwards and a beam of light 73 upwards. At large conduction angles β, light is radiated both downwards in beam 72 and upwards in beam 73. As the conduction angle β decreases, the light radiated upwards in beam 73 decreases, while the light radiated downwards in beam 72 may also decrease, however, to a lesser extent. As the conduction angle β decreases further, the point will be reached where no light is radiated upwards anymore, while light is still radiated downwards. Accordingly, by operating a string of LED segments 11, 12, 13 and 14, in the manner explained above, enhanced control of the lighting atmosphere is obtained as compared to conventional dimming, where both light radiated upwards and light radiated downwards from the table lamp 71 would be affected by dimming of the LED module in the lamp. If the different LED segments 11, 12, 13 and 14 radiate light of the same color, then the ratio of intensities of the light radiated in beam 72 to the light radiated in beam 73 is affected by dimming the LED module in the lamp. If the different LED segments 11, 12, 13 and 14 radiate light of different colors, then the ratio of intensities of the light radiated in beam 72 to the light radiated in beam 73, as well as the color of the light in each of the beams 72, 73, may be affected by dimming the LED module of the lamp.

Figure 13:
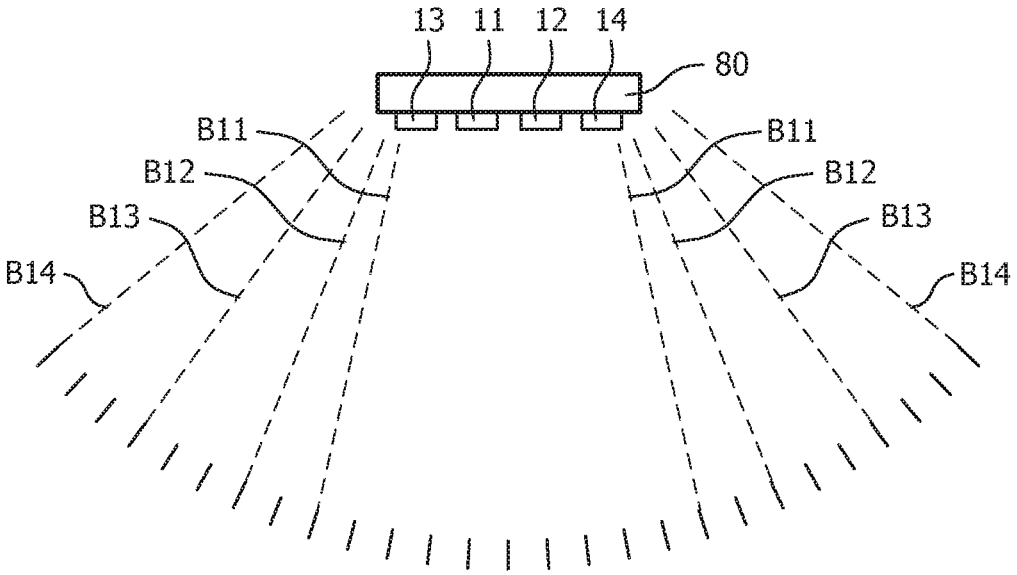
FIG. 13 schematically illustrates beams of radiation emitted from different LED segments of a LED lighting module of the present invention.

FIG. 13 illustrates another configuration of LED segments 11, 12, 13 and 14 on a support 80 of a LED module. All LED segments 11, 12, 13 and 14 radiate light in the same direction. As an example, LED segment 11 radiates light in a beam B11, LED segment 12 radiates light in a beam B12 which is wider than beam B11, LED segment 13 radiates light in a beam B13 which is wider than beams B11 and B12, and LED segment 14 radiates light in a beam B14 which is wider than beams B11, B12 and B13. All beams B11, B12, B13 and B14 demonstrate an overlap.

Figure 14:
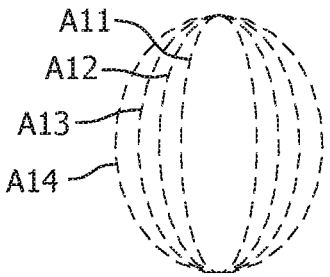
FIG. 14 illustrates different areas illuminated by different LED segments of the lighting module of FIG. 13.

FIG. 14 illustrates exemplary areas A11, A12, A13 and A14 illuminated by the beams B11, B12, B13 and B14, respectively. Thus, an area A11, A12, A13 and A14 can be seen as a cross-section of the beam B11, B12, B13 and B14, respectively, where the beams each at least partly define a volume. It can be seen that in one direction, the areas A11, A12, A13 and A14 have the same dimension, whereas in a direction at right angles to said one direction, area A14 is wider than area A13, area A13 is wider than area A12, and area A12 is wider than area A11.

When the string of LED segments 11, 12, 13 and 14 is not dimmed, an area A14 will be illuminated such that the light intensity and/or the light color within area A11 may be different from the light intensity and/or the light color within area A12 outside area A11, since all LED segments 11, 12, 13 and 14 provide light (having the same or different intensities and/or colors). The same applies to area A13 outside area A12, and to area A14 outside area A13. When dimming the string of LED segments 11, 12, 13 and 14, such as by phase-cut dimming and/or voltage-amplitude dimming, gradually less light will be provided to area A14 outside area A13, area A13 outside area A12, and area A12 outside area A11, until the point is reached where only light is provided to area A11. Accordingly, the illuminated area narrows when dimming increases.

Figure 15A:
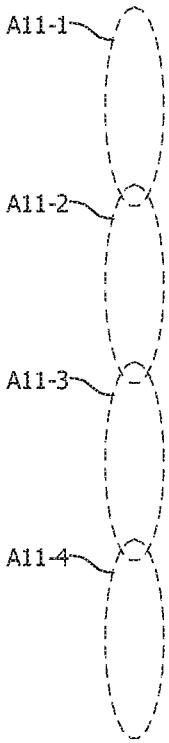
FIGS. 15*a*, 15*b*, 15*c* and 15*d* illustrate different composite areas illuminated by different LED segments of different LED lighting modules of FIG. 13 arranged in a row.
Figure 15B:
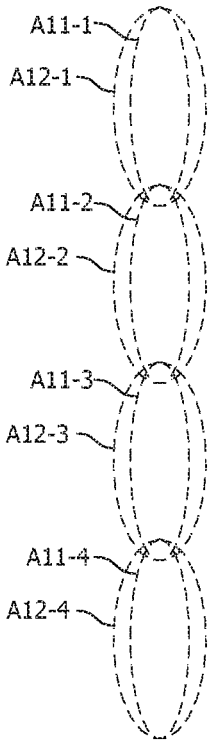
Figure 15C:
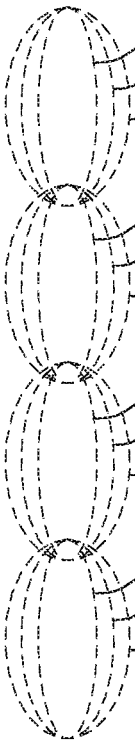
Figure 15D:
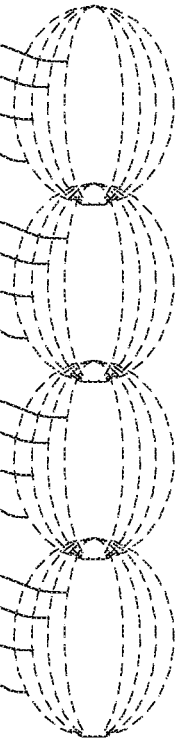

When a chain of LED modules, each comprising LED segments 11, 12, 13 and 14, is arranged in a spaced configuration along a line to illuminate, for example, a corridor having a length and a width, with said line extending at the upper part of the corridor in the length direction thereof, and the light is directed to the floor of the corridor, the corridor can be illuminated as illustrated in FIGS. 15*a*, 15*b*, 15*c* and 15*d*. If all (in the non-limiting, illustrated example: four) LED modules are dimmed in the same way, then, in a non-dimming state, a string of areas A14-1, A14-2, A14-3 and A14-4 will be illuminated, as a result of which the light intensity and/or the light color within areas A11-1, A11-2, A11-3 and A11-4 may be different from the light intensity and/or the light color within areas A12-1, A12-2, A12-3 and A12-4 outside areas A11-1, A11-2, A11-3 and A11-4, since all LED segments 11, 12, 13 and 14 of all LED modules provide light (having the same or different intensities and/or colors). The same applies to areas A13-1, A13-2, A13-3 and A13-4 outside areas A12-1, A12-2, A12-3 and A12-4, and to areas A14-1, A14-2, A14-3 and A14-4 outside areas A13-1, A13-2, A13-3 and A13-4. This is illustrated in FIG. 15*d*. When dimming the string of LED segments 11, 12, 13 and 14 of the LED modules, such as by phase-cut dimming and/or voltage amplitude dimming, gradually less light will be provided to areas A14-1, A14-2, A14-3 and A14-4 outside areas A13-1, A13-2, A13-3 and A13-4, until areas A14-1, A14-2, A14-3 and A14-4 outside areas A13-1, A13-2, A13-3 and A13-4 are not illuminated anymore (as illustrated in FIG. 15*c*), gradually less light will be provided to areas A13-1, A13-2, A13-3 and A13-4 outside areas A12-1, A12-2, A12-3 and A12-4, until areas A13-1, A13-2, A13-3 and A13-4 outside areas A12-1, A12-2, A12-3 and A12-4 are not illuminated anymore (as illustrated in FIG. 15*b*), and gradually less light will be provided to areas A12-1, A12-2, A12-3 and A12-4 outside areas A11-1, A11-2, A11-3 and A11-4, until the point is reached where only light is provided to areas A11-1, A11-2, A11-3 and A11-4 (as illustrated in FIG. 15*a*). Accordingly, the illuminated elongated area narrows when dimming increases. Such dimming of LEDs lighting a corridor is useful to adapt the width of the lighting to a use condition of the corridor, e.g. no dimming and consequently full width in periods of normal use, and adapted dimming in periods of reduced use, while maximum dimming may be adapted to maintain a safe lighting level in a central region of a corridor, while reducing the power consumption of the LED modules.

The invention as illustrated and described above is generally applicable at different mains voltages and mains frequencies, such as 230 V, 50 Hz in Europe or 110 V, 60 Hz in the USA. At 50 Hz, a half cycle (0-180 degrees) of the mains voltage takes 10 ms. At 60 Hz, a half cycle of the mains voltage takes 0.83 ms.

As explained above, in a method of lighting at least part of a space, a light emitting diode (LED) string is used. The LED string comprises a first LED segment and at least one further LED segment connected in series, each LED segment comprising at least one LED. The LED string is powered by a rectified AC voltage. The first LED segment is powered when the rectified AC voltage is above a first voltage level, and the first LED segment and the further LED segment are powered when the rectified AC voltage is above a second voltage level higher than the first voltage level. The first LED segment is arranged to radiate light to a first volume of the space, and the further LED segment is arranged to radiate light to a second volume of the space, the first volume being at least partly different from the second volume. The first volume may at least partly overlap the second volume.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope thereof.

The invention claimed is:

1. An apparatus comprising an LED module for lighting at least part of a space, the LED module comprising:

an LED string, the LED string comprising a first LED segment and at least a second LED segment, wherein each LED segment comprises at least one LED;

wherein the LED string is adapted to be powered by a rectified dimmable AC voltage the rectified dimmable AC voltage comprising a plurality of dimming levels;

wherein the first LED segment is adapted to be powered when the rectified AC voltage is above a first voltage level, and the first LED segment and the second LED segment are adapted to be powered when the rectified AC voltage is above a second voltage level higher than the first voltage level, wherein the first LED segment is arranged to radiate light in a first beam, and the second LED segment is arranged to radiate light in a second beam, wherein one of: (1) the first LED segment is disposed opposing the second LED segment, and the first LED segment is disposed such the first beam radiates light in a direction opposing the second beam, and (2) the second beam is wider than the first beam, and wherein, the light radiated by the first LED segment and by the second LED segment changes with the dimming level of the rectified dimmable AC voltage.

2. The apparatus of claim 1, wherein the second beam is wider than the first beam.

3. The apparatus of claim 1, wherein the first LED segment is arranged to radiate light in the first beam to a first volume of the space, and the second LED segment is arranged to radiate light in the second beam to a second volume of the space, the first volume being at least partly different from the second volume.

4. The apparatus of claim 1, wherein the second volume includes the first volume, wherein the space includes a corridor, and wherein a width of the part of the corridor which the LED module illuminates narrows as the dimming level of the rectified dimmable AC voltage increases.

5. The apparatus of claim 3, further comprising a support, wherein the first LED segment and the first volume are disposed at a first side of the support above the support, and the second LED segment and the second volume are disposed at a second side of the support below the support.

6. The apparatus of claim 5, wherein the first LED segment and the first volume are disposed at the first side of the support above the support, and the second LED segment and second volume are disposed at the second side of support below the support.

7. The apparatus of claim 6, wherein a ratio of the light in the first volume above the support to the light in the second volume below the support decreases as the dimming level of the rectified dimmable AC voltage increases.

8. The apparatus of claim 1, wherein the color temperature of the light radiated by the first LED segment is different from the color temperature of the light radiated by the second LED segment.

9. The apparatus of claim 1, wherein the LED module includes a plurality of terminals connected to the LED segments, the apparatus further comprising an LED driver, the LED driver comprising:

LED driver input terminals configured to be connected to a rectified AC voltage from a power supply; and LED driver output terminals connected to the terminals of the LED module.

10. The apparatus of claim 9, wherein the LED driver is configured to supply current from the power supply to the LED module, wherein the current has a first current level when the rectified dimmable AC voltage is greater than the first voltage level and less than the second voltage level while the first LED segment is powered and the second LED segment is not powered, and wherein the current has a second current level which is less than the first current level when the rectified dimmable AC voltage is greater than the second voltage level while the first and second LED segments are both powered.

11. The apparatus of claim 9, wherein the LED string further includes a third LED segment connected in series with the first and second LED segments, wherein the first, second, and third LED segments are all configured to be powered when the rectified AC voltage is greater than a third voltage level which is greater than the second voltage level, wherein the LED driver is configured to supply current from the power supply to the LED module, wherein the current has a first current level when the rectified dimmable AC voltage is greater than the first voltage level and less than the second voltage level while the first LED segment is powered and the second and third LED segments are not powered, wherein the current has a second current level which is less than the first current level when the rectified dimmable AC voltage is greater than the second voltage level while the first and second LED segments are both powered and the third LED segment is not powered, and wherein the current has a third current level which is less than the second current level when the rectified dimmable AC voltage is greater than the third voltage level while the first, second and third LED segments are all powered.

12. The apparatus of claim 9, the LED driver circuit comprising:

a switching device connected in parallel to the second LED segment; and control circuitry for controlling an open state or a closed state of the switching device, the control circuitry being adapted to control the switching device so as to be in a closed state when the rectified AC voltage is less than the second voltage level, and to control the switching device connected to the second LED segment so as to be in an open state when the rectified AC voltage is greater than the second voltage level.

13. The apparatus of claim 9, the LED driver circuit comprising:

a switching device connected in parallel to the first LED segment, and a switching device connected in parallel to the second LED segment; and control circuitry for controlling an open state or a closed state of each switching device, the control circuitry being adapted to control the switching device connected in parallel to the first LED segment so as to be in an open state and the switching device connected in parallel to the second LED segment to be in a closed state when the rectified AC voltage is above the first voltage level and below the second voltage level higher than the first voltage level, and to control the switching device connected to the second LED segment so as to be in an open state when the rectified AC voltage is above the second voltage level.

14. The apparatus of claim 9, the LED driver circuit comprising:

for each LED segment, a current control device connected between one terminal of the LED segment and an LED driver input terminal; and control circuitry for controlling a current in each current control device, the control circuitry being adapted to control the current control device of the first LED segment so as to allow a current to flow when the rectified AC voltage is above a first voltage level, and disallow a current to flow when the rectified AC voltage is above a second voltage level higher than the first voltage level.

15. The apparatus of claim 14, further comprising a rectifier and a dimming device.

16. The apparatus of claim 12, wherein the dimming device is a phase-angle cutting dimmer.

17. The apparatus of claim 11, wherein the dimming device changes the voltage amplitude.

18. The apparatus of claim 9, wherein the LED driver further includes a current control device connected between the LED driver input terminals.

19. The apparatus of claim 18, wherein the current control device is adapted to pulse width modulate a current flowing through it.

20. A method of lighting, using a light emitting diode (LED) string, the LED string comprising a first LED segment and at least a second LED segment, each LED segment comprising at least one LED, the LED string being powered by a rectified dimmable AC voltage, the rectified dimmable AC voltage comprising a plurality of dimming levels, the method comprising:

powering the first LED segment when the rectified dimmable AC voltage is above a first voltage level, and powering the first LED segment and the second LED segment when the rectified AC voltage is above a second voltage level higher than the first voltage level, arranging the first LED segment to radiate light in a first beam, and the second LED segment is arranged to radiate light in a second beam, wherein one of: (1) the first LED segment is disposed opposing the second LED segment, and the first LED segment is disposed such the first beam radiates light in a direction opposing the second beam, and (2) the second beam is wider than the first beam, and wherein the light radiated by the first LED segment and by the second LED segment changes with the dimming level of the rectified dimmable AC voltage.

* * * * *